US006483379B1

(12) United States Patent
Culca

(10) Patent No.: US 6,483,379 B1
(45) Date of Patent: Nov. 19, 2002

(54) INPUT CIRCUIT FOR RELATIVELY HIGH CURRENT AC SIGNALS TO BE MONITORED

(75) Inventor: Horea-Stefan Culca, Lohmar (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/737,025

(22) PCT Filed: Apr. 1, 2000

(86) PCT No.: PCT/EP00/02924

§ 371 (c)(1),
(2), (4) Date: Dec. 14, 2000

(87) PCT Pub. No.: WO00/63930

PCT Pub. Date: Oct. 26, 2000

(30) Foreign Application Priority Data

Apr. 14, 1999 (DE) ..... 199 16 686

(51) Int. Cl.[7] ..... G05F 3/02
(52) U.S. Cl. ..... 327/544; 327/538
(58) Field of Search ..... 327/547, 544, 327/538, 531, 530, 446, 447, 143, 260; 340/855.19, 401.1; 324/411, 412, 552, 111; 307/2, 53, 110; 361/93.9

(56) References Cited

U.S. PATENT DOCUMENTS 4,000,455 A * 12/1976 Gygui et al. ..... 323/119
4,047,097 A * 9/1977 Gyugyi et al. ..... 307/135
4,245,150 A 1/1981 Carleton et al. ..... 327/143
4,437,134 A * 3/1984 Dupraz ..... 324/111
5,394,028 A * 2/1995 Feddeler et al. ..... 327/544
5,812,386 A * 9/1998 Youn ..... 327/544
6,002,542 A * 12/1999 Bruccleri et al. ..... 360/77.11
6,094,095 A * 7/2000 Murray et al. ..... 327/530
6,177,803 B1 * 1/2001 Train et al. ..... 324/552

FOREIGN PATENT DOCUMENTS

| | | |
|---|---|---|
| EP | 0505951 | 9/1992 |
| FR | 2671437 | 7/1992 |
| GB | 1254975 | 11/1971 |

* cited by examiner

*Primary Examiner*—Timothy P. Callahan
*Assistant Examiner*—Linh Nguyen
(74) *Attorney, Agent, or Firm*—Horst M Kasper

(57) ABSTRACT

The invention relates to an input circuit for relatively high-current alternating current-signals to be monitored. Said input circuit is provided with a capacitor (C) at the input side for supplying a relatively high input current on the basis of an AC supply voltage (L1) by the switched off device (1; 2) to be monitored. At the input side a discharge circuit (23) is provided in parallel for quickly detecting any changes of state of the device (1; 2) to be monitored. Said discharge circuit has a small discharge resistance (Rc) vis-à-vis the input resistance (Re). The discharge circuit (23) is further provided with a switch element (S3) that is blocked when the current supply voltage (L1) and the threshold voltage (Ustyp) to be recognized have the same polarity and that is conductive when they are of different polarity.

13 Claims, 2 Drawing Sheets

Figure 3:
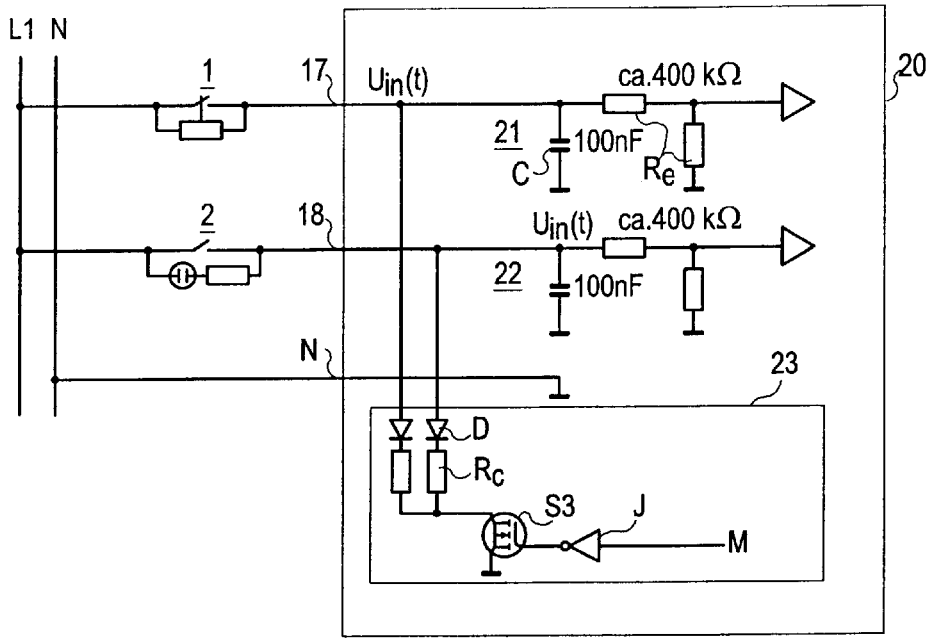

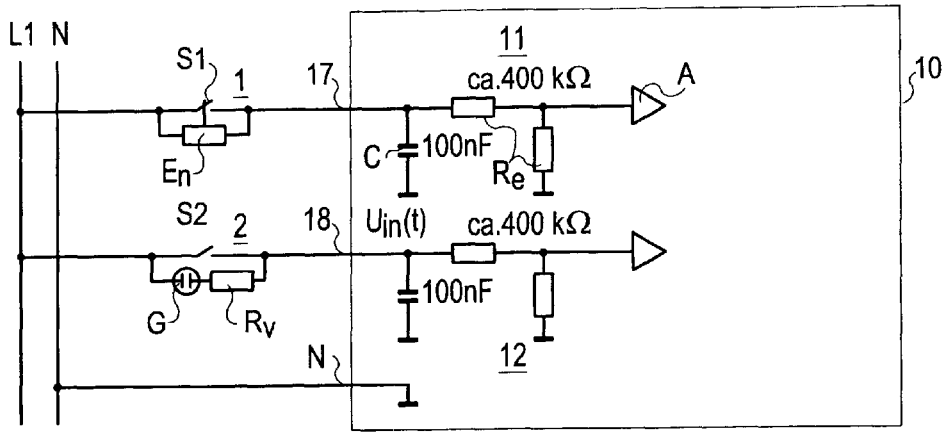
PRIOR ART Fig. 1
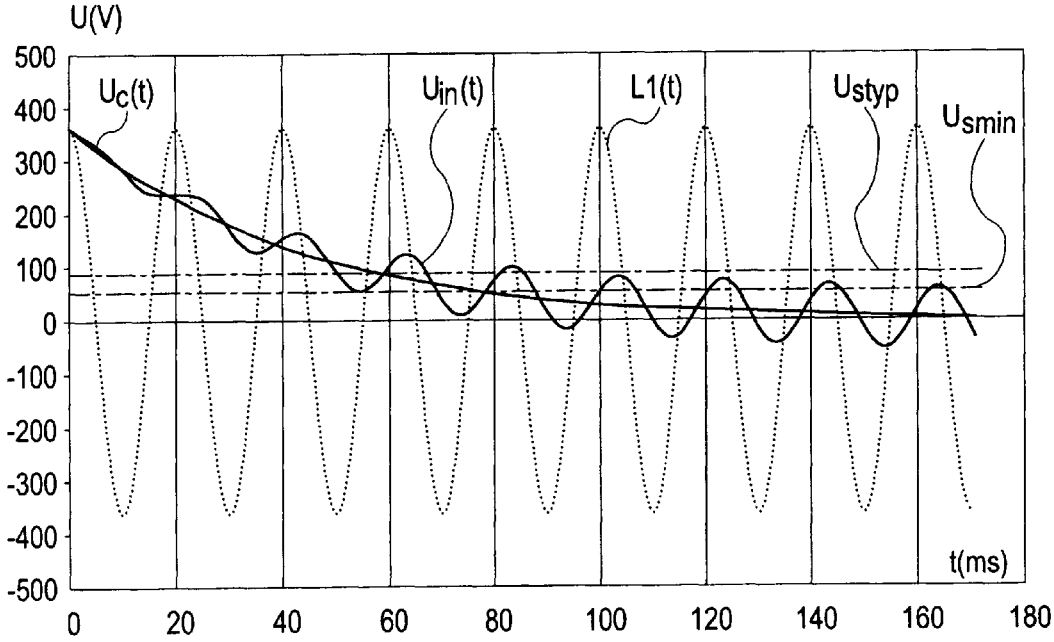
PRIOR ART Fig. 2

INPUT CIRCUIT FOR RELATIVELY HIGH CURRENT AC SIGNALS TO BE MONITORED

TECHNICAL FIELD

The invention relates to an input circuit for relatively high current alternating voltage signals to be monitored, which alternating voltage signals are to be monitored relative to a pre-settable amplitude threshold value. Such input circuits are employed for example in small control circuits.

STATE OF THE ART

Input circuits for monitoring of alternating current signals are generally known and by way of example in printed patent document FR 2671437 A1 recited here. In order to maintain a low dissipation power loss, such input circuits require small input currents. Some devices to be monitored, for example switches furnished with a glow discharge lamp or proximity switches require, however, higher input currents into the input circuit for a problem free functioning. It is usual for these cases to furnish the input circuit with a parallel connected capacitor on the input side in order to assure the necessary current for the device to be monitored. The disadvantage of this construction comprises that upon switching off of the device to be monitored in the region of the apex of its alternating current supply voltage, then the capacitor can discharge only relatively slow starting from a high-value through the high ohm input resistance. Furthermore a residual current flows through such devices in a disconnected state, wherein the residual current causes a substantial residual voltage at the input. The two processes enable the perception of the switched off state of the device to be monitored only after a plurality of alternating voltage periods of the supply voltage and not—as desired—already within one period.

A circuit arrangement for monitoring of a defined amplitude threshold value of alternating voltage shaped input signals is described in the not yet published German printed patent document DE 19748633 A1of the applicant, comprising a series connection of a rectifier, a voltage divider disposed with its anode at an input signal and with its cathode feeding the voltage divider comprising at least two resistors and disposed between anode of the rectifier and mass potential and wherein the tap of the voltage divider is connected to the comparison input of the comparator such that a first binary signal is generated at the output of the comparator, furthermore with a zero passage detector, wherein the monitored input of the zero passage detector is the switch with reference signal for forming of a second binary signal, a delay stage connected to the output side of the zero passage detector for forming of a time limited third binary signal, and with at least one signal edge controlled flip-flop, wherein the comparator output is connected to a status controlled input of the flip-flop and wherein the output of the delay stage is connected to a signal edge controlled input of the flip-flop such that a status distinguishing for signal is generated at the output of the flip-flop. This switching arrangement is not suitable for a quick monitoring of a relatively high current input signal, which is realized by an input side connection switching of a parallel capacitor.

PRESENTATION OF THE INVENTION

It is therefore an object of the present Invention to improve the input circuit in such a way that a turn off of devices, which deliver a relatively high input current, can be quickly captured.

Starting with an input circuit of the initially recited kind, the object is accomplished according to the present invention by the characterizing features of the independent claim, while advantageous further developments of the invention can be gathered from the dependent claims.

The voltage is lowered very quickly with respect to its amount to below the threshold value through the capacitor and thereby the input voltage is lowered very quickly to below the threshold value through the capacitor based on the discharge circuit added according to the present invention even in cases where the device to be monitored is switched off at the apex of the supply voltage, such that the switching off of the device to be monitored is rapidly captured. The quick recognizability of the switching on of the device to be monitored remains based on the low output resistance in a switched on state of the device to be monitored.

An advantageous further development of the Invention comprises that the discharge resistance is of low ohm resistance relative to the output resistance of the switched off device to be monitored. The lowering of the input voltage below the threshold value becomes recognizable at the latest after an alternating voltage period.

An advantageous further development of the invention comprises further the common and joint application of the switching element for several inputs of the same kind, in particular also upon application of only one common and joint discharge resistor in case of a not too large a number of inputs.

Advantageously, the discharge circuit comprises a series connection of rectifier, discharge resistor, and switching element; wherein the switching element is formed advantageously as a transistor.

SHORT DESCRIPTION OF THE DRAWINGS

Figure 4:
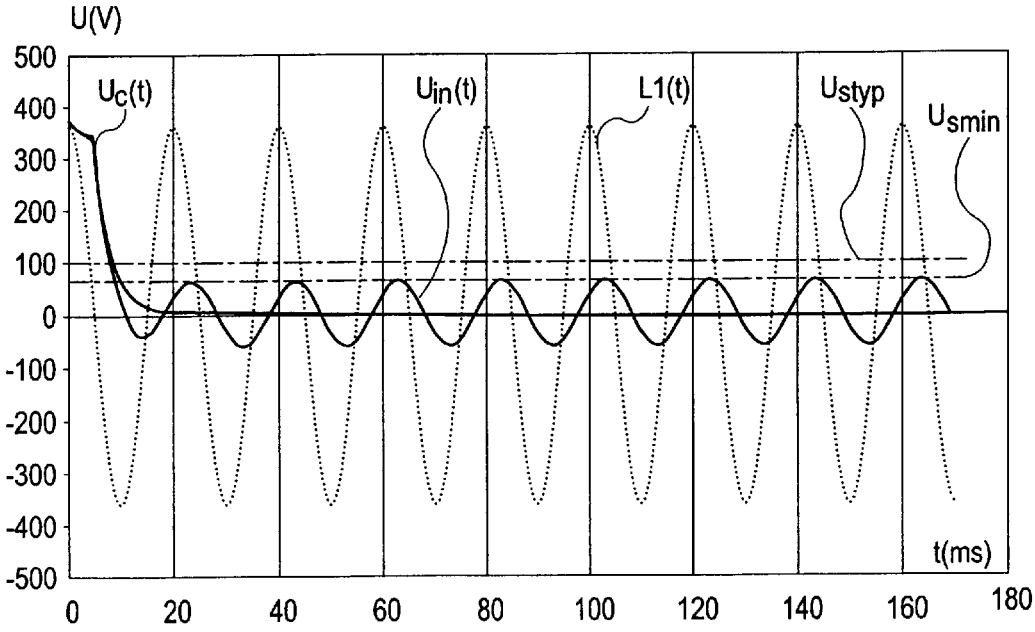

Further details and advantages of the invention result from the following by way of the embodiment illustrated in the figures. There is shown in:

FIG. 1: a circuit arrangement with input circuit according to the state-of-the-art;

FIG. 2: typical voltage courses and signal courses for the circuit arrangement according to FIG. 1;

FIG. 3: a switching circuit with input circuit according to the present invention;

FIG. 4: typical voltage courses and signal courses for the circuit arrangement according to FIG. 3.

BEST PATH FOR PERFORMING THE INVENTION

The circuit arrangement according to FIG. 1 shows by way of example an indicated small control circuit 10 with two signal inputs 17 and 18, wherein relatively high current alternating current signals of two devices 1 and 2 to be monitored are led to two corresponding input circuits 11 and 12 through the two signal inputs 17 and 18. The first device 1 is a proximity switch, wherein the proximity switch essentially comprises the parallel connection of a first, electronic switching element S1 and the control electronics En coupled to the first electronic switching element S1. The second device 2 is a second switching element S2 with parallel connected glow discharge lamp G with a shunt resistance Rv. The devices 1 and 2 to be monitored are fed by an alternating current supply voltage L1. The zero potential N is employed as a ground mass in the small control circuit 10. The input circuits 11 and 12 are formed in a conventional way and comprise successively following a capacitor C disposed between the signal input 17 or, respectively, 18 and the zero potential N, and input resistor Re operating as a voltage divider, as well as an input of an electronic module A fed by the input resistor Re, wherein the electronic module A is for example a comparator. Remarkable input currents determined essentially by the control electronics En or, respectively, the shunt resistor Rv flow into the signal inputs 17 and 18 in a switched off state of the devices 1 and 2, that is while the switching elements S1 and S2 are open, and from the signal inputs 17 and 18 essentially to ground mass through the capacitors C. The potential of the supply voltage L1 passes to the signal inputs 17, 18 through the switching elements S1 and S2 in a switched on state of the devices 1, 2 and thereby to the capacitors C as well attenuated and weakened and without delay to the module A and thus to further evaluation. Upon switching off of the devices 1, 2 during the positive half wave of the supply voltage L1, the potential dismantlement is performed at the signal inputs 17, 18 and thus at the inputs of the module A with substantial delay.

This is to be illustrated by way of example in connection with the associated potential diagram according to FIG. 2. A positive amplitude threshold value and a switching off at the apex of the supply voltage L1 of the device to be monitored is to be assumed. The discharge voltage Uc(t) of the capacitor C reaches the typical threshold voltage Ustyp only after scanty three periods (60 milliseconds) after switching off of the device to be monitored 1 or, respectively, 2 and reaches the input voltage Uin(t) generated by super position with the residual voltage only after four periods (80 milliseconds). The switching off of the device 1 or, respectively, 2 is perceived even only after six periods (120 milliseconds) on the base of the worst-case threshold voltage Usmin.

The circuit arrangement according to FIG. 3 shows again by way of example an indicated small control circuit 20 with two signal inputs 17 and 18, wherein relatively high current alternating-current signals of the devices 1 and 2 to be monitored are led to two input circuits 21 and 22 through the signal inputs 17 and 18. The devices 1 and 2 to be monitored are equal to those of FIG. 1. The input circuits 21 and 22 according to the present invention have been extended by a common discharge circuit 23 disposed between the signal inputs 17 and 18 and zero potential N relative to the usual input circuits 11 and 12. The discharge circuit 23 comprises a series connection of a rectifier D coordinated in each case to one of the inputs 17 and 18 and of the discharge resistor Rc as well as a common electronic switching element S3 in the form of a MOS-switching transistor. The switching element S1 is controlled by a control signal M through an inverter I. The control signal N is derived from the supply voltage L1 in such a way that the control signal N assumes high potential or, respectively, low potential during the positive or, respectively, negative half wave of the supply voltage L1, that is the control signal N changes state in each case during zero passage of the supply voltage L1. (Reference is made in this connection to the initially recited German patent application 197 48 633.9 of the applicant. The second digital signal generated according to the German patent application 197 48 633.9 corresponds to the control signal M employed in the present disclosure).

The electronic switching element S3 is consequently blocked during the positive half wave of the supply voltage L1 and is conducting during the negative half wave. The potential of the supply voltage L1 passes undiminished to the inputs 17 or, respectively, 18 while the device 1 or, respectively, 2 is switched on, since the respective diode D is blocked during the negative half wave and the switching element S3 is blocked during the positive half wave. If however the corresponding device 1 or, respectively, 2 is switched off during the positive half wave of the supply voltage L1, then switching element S3 becomes conductive to the low potential of the control signal M after the next zero passage of the supply voltage L1, while the corresponding respective rectifier D remains conductive based on the positive input voltage Uin(t) present at the respective capacitor C, until the discharge voltage Uc(t) of the capacitor C and thus the input voltage Uin(t) to be evaluated have sunk and fallen quickly under the worst-case-threshold voltage Usmin and thereby certainly under the typical threshold voltage Ustyp to be recognized within this first negative half period (20 milliseconds) of the supply voltage. The discharge resistance Rc has to protect the electronic switching element S3 against overloading.

The present invention is not limited to the precedingly described embodiment, but comprises also all embodiments operating in the same way as the sense of present invention. For example the values given for the input resistances Re and the capacitors C in FIG. 1 and FIG. 3 are only representations by example, however, they are not atypical. A common discharge resistor Rc, which is disposed in series with the common switching element S3, can be sufficient in case of a small number of inputs. Furthermore, it can be advantageous in certain application situations, if a separate switching element is coordinated to each rectifier D and to each discharge resistor Rc. In addition, it is without problem possible to enable the input circuit 21 or, respectively, 22 according to the present invention for the capturing of negative threshold values by corresponding reversal of polarity of the rectifier D as well as a corresponding selection of the switching element S3.

LIST OF REFERENCE NUMERALS

1; 2 device
10 small control circuit
11; 12 input circuit
17; 18 signal inputs
20 small control circuit
21; 22 input circuit
23 discharge circuit
A module
C capacitor
D rectifier
En control electronics
G glow discharge lamp
I inverter
L1 supply voltage
M control signal
Rc discharge resistor
Re input resistor
Rv shunt resistor
S1;S2;S3 switching element
Uc(t) discharge voltage
Uin(t) input voltage
Usmin worst-case threshold voltage
Ustyp typical threshold voltage

What is claimed is:

1. Input circuit for monitoring alternating current signals, with an input resistance (Re) and a capacitor (C) connected in parallel on the input side, wherein an input current is delivered to the capacitor (C) based on an alternating current supply voltage (L1) to switched off devices (1; 2), characterized in that in addition a discharge circuit (23) is disposed parallel on the input side, wherein the discharge resistance (Rc) of the discharge circuit (23) is small relative to the input resistance (Re), wherein the discharge circuit (23) includes a switching element (S3), wherein the switching element (S3) is blocked while the sign of the momentary supply voltage (L1) and of the threshold voltage (Ustyp) to be recognized is the same, whereas in contrast the switching element (S3) is conducting while the sign of the momentary supply voltage (L1) and of the threshold voltage (Ustyp) to be recognized is opposite and wherein the discharge circuit (23) comprises a series connection of a rectifier (D) directed in the sign direction of the threshold voltage (Ustyp), the discharge resistor (Rc), and the switching element (S3).

2. Input circuit according to claim 1, characterized in that the discharge resistance (Rc) is a low ohm resistance relative to the output resistance of the switched off devices (1; 2).

3. Input circuit according to claim 1, characterized in that a common switching element (S3) is furnished for discharge circuits (23) belonging to same kind inputs (17; 18), wherein the switched off devices (1; 2) are fed by the same alternating current supply voltage (L1).

4. Input circuit according to claim 3, characterized in that a common discharge resistor (Rc) is furnished.

5. Input circuit according to claim 1, characterized in that the switching element (S3) is a transistor.

6. An input circuit for monitoring alternating current signals comprising a first switch (1);

a second switch (2);

a first input resistance (Re) connected to the first switch (1);

a second input resistance (Re) connected to the second switch (2);

a first capacitor (C) connected to the first switch (1) and connected in parallel to the first input resistance (Re) on an input side;

a second capacitor (C) connected to the second switch (2) and connected in parallel to the second input resistance (Re) on the input side;

an alternating current supply voltage (L1) connected to the first switch (1) and thereby to the first input resistance (Re) and to the first capacitor (C) for delivering a relatively high input current to the first capacitor (C) based on the alternating current supply voltage (L1) delivered to the first switch (1), and connected to the second switch (2) and thereby to the second input resistance (Re) and to the second capacitor (C) for delivering a relatively high input current to the second capacitor (C) based on the alternating current supply voltage (L1) delivered to the second switch (2), a discharge circuit (23) is disposed parallel on the input side, wherein a discharge resistance (Rc) of the discharge circuit (23) is small relative to the first input resistance (Re) and to the second input resistance (Re), wherein the discharge circuit (23) includes an electronic switching element (S3), wherein the electronic switching element (S3) is blocked while the sign of the momentary supply voltage (L1) and of the threshold voltage (Ustyp) to be recognized is the same, whereas in contrast the electronic switching element (S3) is conducting while the sign of the momentary supply voltage (L1) and of the threshold voltage (Ustyp) to be recognized is opposite and wherein the discharge circuit (23) comprises a series connection of a rectifier (D) directed in the sign direction of the threshold voltage (Ustyp), the discharge resistor (Rc), and the electronic switching element (S3).

7. The input circuit according to claim 6, wherein the discharge circuit includes a discharge resistance (Rc) and wherein the discharge resistance (Rc) is a low ohm resistance relative to a first output resistance of the switched off first switch (1) and relative to a second output resistance of the second switch (2) to be monitored.

8. The input circuit according to claim 7, wherein the discharge resistance (Rc) is a common discharge resistor and wherein the common discharge resistor is furnished for the discharge circuit (23) belonging to same kind inputs (17; 18), and wherein the first switch (1) and the second switch (2) are fed by the same alternating current supply voltage (L1).

9. The input circuit according to claim 6, wherein the switching element (S3) is a common switching element, wherein the common switching element is furnished for the discharge circuit (23) belonging to same kind inputs (17; 18), and wherein the first switch (1) and the second switch (2) are fed by the same alternating current supply voltage (L1).

10. The input circuit according to claim 6, wherein the electronic switching element (S3) is a transistor.

11. The input circuit according to claim 6, wherein the discharge circuit (23) includes a discharge resistance (Rc) and wherein the discharge resistance (Rc) is a low ohm resistance relative to a first output resistance of the switched off first switch (1) and relative to a second output resistance of the second switch (2), wherein the first switch (1) and the second switch (2) are fed by the same alternating current supply voltage (L1);

wherein the discharge resistance (Rc) is furnished for the discharge circuit (23) belonging to same kind inputs (17; 18).

12. An input circuit for monitoring alternating current signals, with an input resistance (Re) and a capacitor (C) connected in parallel on the input side, wherein an input current is delivered to the capacitor (C) based on an alternating current supply voltage (L1) to switched off devices (1; 2), wherein in addition a discharge circuit (23) is disposed parallel on the input side, wherein alternating current inputs are speeded up by a quick discharging of the capacitor (C), wherein the discharge resistance (Rc) of the discharge circuit (23) is small relative to the input resistance (Re), wherein the discharge circuit (23) includes a switching element (S3), wherein the switching element (S3) is blocked while the sign of the momentary supply voltage (L1) and of the threshold voltage (Ustyp) to be recognized is the same, whereas in contrast the switching element (S3) is conducting while the sign of the momentary supply voltage (L1) and of the threshold voltage (Ustyp) to be recognized is opposite.

13. An input circuit for monitoring alternating current signals comprising a first switch (1);

a second switch (2);

a first input resistance (Re) connected to the first switch (1);

a second input resistance (Re) connected to the second switch (2);

a first capacitor (C) connected to the first switch (1) and connected in parallel to the first input resistance (Re) on an input side, wherein alternating current inputs are speeded up by a quick discharging of the capacitor (C) and wherein a logical "0" is quickly reached;

a second capacitor (C) connected to the second switch (2) and connected in parallel to the second input resistance (Re) on the input side, wherein alternating current inputs are speeded up by a quick discharging of the capacitor (C) and wherein a logical "0" is quickly reached;

an alternating current supply voltage (L1) connected to the first switch (1) and thereby to the first input resistance (Re) and to the first capacitor (C) for delivering a relatively high input current to the first capacitor (C) based on the alternating current supply voltage (L1) delivered to the first switch (1), and connected to the second switch (2) and thereby to the second input resistance (Re) and to the second capacitor (C) for delivering a relatively high input current to the second capacitor (C) based on the alternating current supply voltage (L1) delivered to the second switch (2), a discharge circuit (23) is disposed parallel on the input side, wherein a discharge resistance (Rc) of the discharge circuit (23) is small relative to the first input resistance (Re) and to the second input resistance (Re), wherein the discharge circuit (23) includes a switching element (S3), wherein the switching element (S3) is blocked while the sign of the momentary supply voltage (L1) and of the threshold voltage (Ustyp) to be recognized is the same, whereas in contrast the switching element (S3) is conducting while the sign of the momentary supply voltage (L1) and of the threshold voltage (Ustyp) to be recognized is opposite.

* * * * *